US011181032B2

(12) United States Patent
Kessens et al.

(10) Patent No.: US 11,181,032 B2
(45) Date of Patent: Nov. 23, 2021

(54) CYLINDER HEAD WITH IMPROVED VALVE BRIDGE COOLING

(71) Applicant: Deere & Company, Moline, IL (US)

(72) Inventors: Jeremy M. Kessens, Waterloo, IA (US); Douglas S. Brocco, Waterloo, IA (US); Kaleb Zimmerman, Cedar Falls, IA (US); Gerald W. Green, Cedar Falls, IA (US)

(73) Assignee: DEERE & COMPANY, Moline, IL (US)

( * ) Notice: Subject to any disclaimer, the term of this patent is extended or adjusted under 35 U.S.C. 154(b) by 35 days.

(21) Appl. No.: 16/134,677

(22) Filed: Sep. 18, 2018

(65) Prior Publication Data

US 2020/0088085 A1 Mar. 19, 2020

(51) Int. Cl.

| | |
|---|---|
| ***F01P 3/02*** | (2006.01) |
| ***F02F 1/36*** | (2006.01) |
| *F01P 3/00* | (2006.01) |

(52) U.S. Cl.

CPC ..... *F01P 3/02* (2013.01); *F02F 1/36* (2013.01); *F01P 2003/001* (2013.01); *F01P 2003/024* (2013.01)

(58) Field of Classification Search

CPC ..... F02F 1/38; F02F 1/40; F01P 2003/024

See application file for complete search history.

(56) References Cited

U.S. PATENT DOCUMENTS 4,889,080 A * 12/1989 Oguri ..... F02F 1/40 123/41.82 R
5,357,910 A * 10/1994 Wenger ..... F01P 3/02 123/41.74

(Continued)

FOREIGN PATENT DOCUMENTS

DE 19608576 C1 6/1997
EP 2998555 A1 3/2016

(Continued)

OTHER PUBLICATIONS https://ocw.mit.edu/courses/mechanical-engineering/2-000-how-and-why-machines-work-spring-2002/study-materials/TurbulentFlow.pdf (Year: 2002).*

(Continued)

*Primary Examiner* — Michael A Kessler
(74) *Attorney, Agent, or Firm* — Michael Best & Friedrich LLP

(57) ABSTRACT

A cylinder head for use with an internal combustion engine, the cylinder head including a body having a fire deck and defining a water jacket in fluid communication with a cooling system, a first runner defined by the body and open to the fire deck to at least partially form a first valve seat, a second runner defined by the body and open to the fire deck to at least partially form a second valve seat, and a channel defined by the in fluid communication with the water jacket and positioned between the first runner and the second runner. The channel, in turn, includes a first inlet through which a first flow enters the channel, a second inlet through which a second flow enters the channel, and where the first inlet and the second inlet are oriented such that the first flow and the second flow interact with one another to create a turbulent region within the channel.

13 Claims, 8 Drawing Sheets

(56) References Cited

U.S. PATENT DOCUMENTS

| | | | | |
|---|---|---|---|---|
| 6,817,322 | B2 * | 11/2004 | Hardin | F02B 75/20 123/41.82 R |
| 9,309,830 | B2 * | 4/2016 | Berger et al. | F01P 3/16 |
| 10,094,326 | B2 * | 10/2018 | Poschl | F02F 1/38 |
| 2009/0000578 | A1 * | 1/2009 | Reustle | B22D 19/0009 123/41.82 R |
| 2016/0084194 | A1 * | 3/2016 | Green | F02F 1/4235 123/41.74 |
| 2016/0115897 | A1 * | 4/2016 | Poschl | F02F 1/40 123/41.82 R |
| 2018/0223768 | A1 * | 8/2018 | Miura | F02F 1/40 |

FOREIGN PATENT DOCUMENTS

| | | | | |
|---|---|---|---|---|
| EP | 3333398 | A1 * | 6/2018 | F01P 3/02 |
| JP | 61132755 | A * | 6/1986 | F02F 1/24 |
| JP | 06074042 | A * | 3/1994 | F02F 1/40 |
| WO | WO-2004074652 | A1 * | 9/2004 | F02F 1/14 |

OTHER PUBLICATIONS

English Machine Translation of the description for WO-2004074652-A1 provided by WIPO Patentscope (Year: 2020).*

German Search Report issued in counterpart application No. 102019212200.0 dated Apr. 6, 2020 (06 pages).

German Search Report issued in counterpart application No. 102019212115.2 dated Apr. 6, 2020 (10 pages).

* cited by examiner

CYLINDER HEAD WITH IMPROVED VALVE BRIDGE COOLING

FIELD OF THE INVENTION

The present disclosure relates to a cylinder head, and more specifically a cylinder head with improved valve bridge cooling.

BACKGROUND

As combustion temperatures increase to promote more efficient engines with lower emissions, the removal of the heat generated from the combustion event and then rejected to the cylinder head becomes increasingly difficult to manage. This heat creates high thermal stresses in the cylinder head material at the thinnest section between the valve seat inserts which is typically referred to as the valve bridge. The bridge section that is naturally affected the most on a four-valve layout occurs between the two exhaust valves during the expulsion of the hot gasses.

SUMMARY

In one aspect, a cylinder head for use with an internal combustion engine, the cylinder head including a body having a fire deck and defining a water jacket in fluid communication with a cooling system, a first runner defined by the body and open to the fire deck to at least partially form a first valve seat, a second runner defined by the body and open to the fire deck to at least partially form a second valve seat, and a channel defined by the in fluid communication with the water jacket and positioned between the first runner and the second runner. The channel, in turn, includes a first inlet through which a first flow enters the channel, a second inlet through which a second flow enters the channel, and where the first inlet and the second inlet are oriented such that the first flow and the second flow interact with one another to create a turbulent region within the channel.

In another aspect, a cylinder head for use with an internal combustion engine, the cylinder head including a body having a fire deck and defining a water jacket in fluid communication with a cooling system, a first runner defined by the body and open to the fire deck to at least partially form a first valve seat, a second runner defined by the body and open to the fire deck to at least partially form a second valve seat, a channel defined by the body, where the cooling channel is in fluid communication with the water jacket and positioned between the first runner and the second runner, where the channel includes a first inlet configured to direct a first flow into the channel in a first direction, and a second inlet configured to direct a second flow into the channel in a second direction different than the first direction.

In another aspect, a cylinder head for use with an internal combustion engine, the cylinder head including a body having a fire deck and defining a water jacket in fluid communication with a cooling system, a first runner defined by the body and open to the fire deck to at least partially form a first valve seat, a second runner defined by the body and open to the fire deck to at least partially form a second valve seat, a channel defined by the body, where the cooling channel is in fluid communication with the water jacket and positioned between the first runner and the second runner, where the channel includes a first inlet spaced a first distance from the fire deck, and a second inlet spaced a second distance from the fire deck different than the first distance.

In another aspect, a cylinder head for use with an internal combustion engine, the cylinder head including a body having a fire deck and defining a water jacket in fluid communication with a cooling system, a first runner defined by the body and open to the fire deck to at least partially form a first valve seat, a second runner defined by the body and open to the fire deck to at least partially form a second valve seat, a channel defined by the body, where the cooling channel is in fluid communication with the water jacket and positioned between the first runner and the second runner, where the channel defines a first plane passing through the cross-sectional center thereof and oriented perpendicular to the fire deck, and where the channel includes a first inlet configured to direct a first flow into the channel, a second inlet configured to direct a second flow into the channel, and where the first inlet and the second inlet are on opposite sides of the first plane.

Other aspects of the disclosure will become apparent by consideration of the detailed description and accompanying drawings.

DETAILED DESCRIPTION

Before any embodiments of the disclosure are explained in detail, it is to be understood that the disclosure is not limited in its application to the details of the formation and arrangement of components set forth in the following description or illustrated in the accompanying drawings. The disclosure is capable of supporting other implementations and of being practiced or of being carried out in various ways.

This disclosure generally relates to a cylinder head having improved valve bridge cooling capabilities. More specifically, the size and shape of the valve bridge channel extending between and adjacent the two exhaust runners includes a flow diverter configured to produce a turbulent region (e.g., flow having a Reynolds Number>approximately 2300) within the channel by directing at least a portion of the fluid flowing through the valve bridge toward the common wall 198 of the valve bridge and the fire deck. By doing so, the improved valve bridge produces a turbulent region proximate the common wall 198 that provides an increased level of heat transfer between the coolant and the body of the cylinder head while minimizing the pressure drop of the coolant flowing through the valve bridge and minimizing the cooling system's mass flow requirements.

Figure 1:
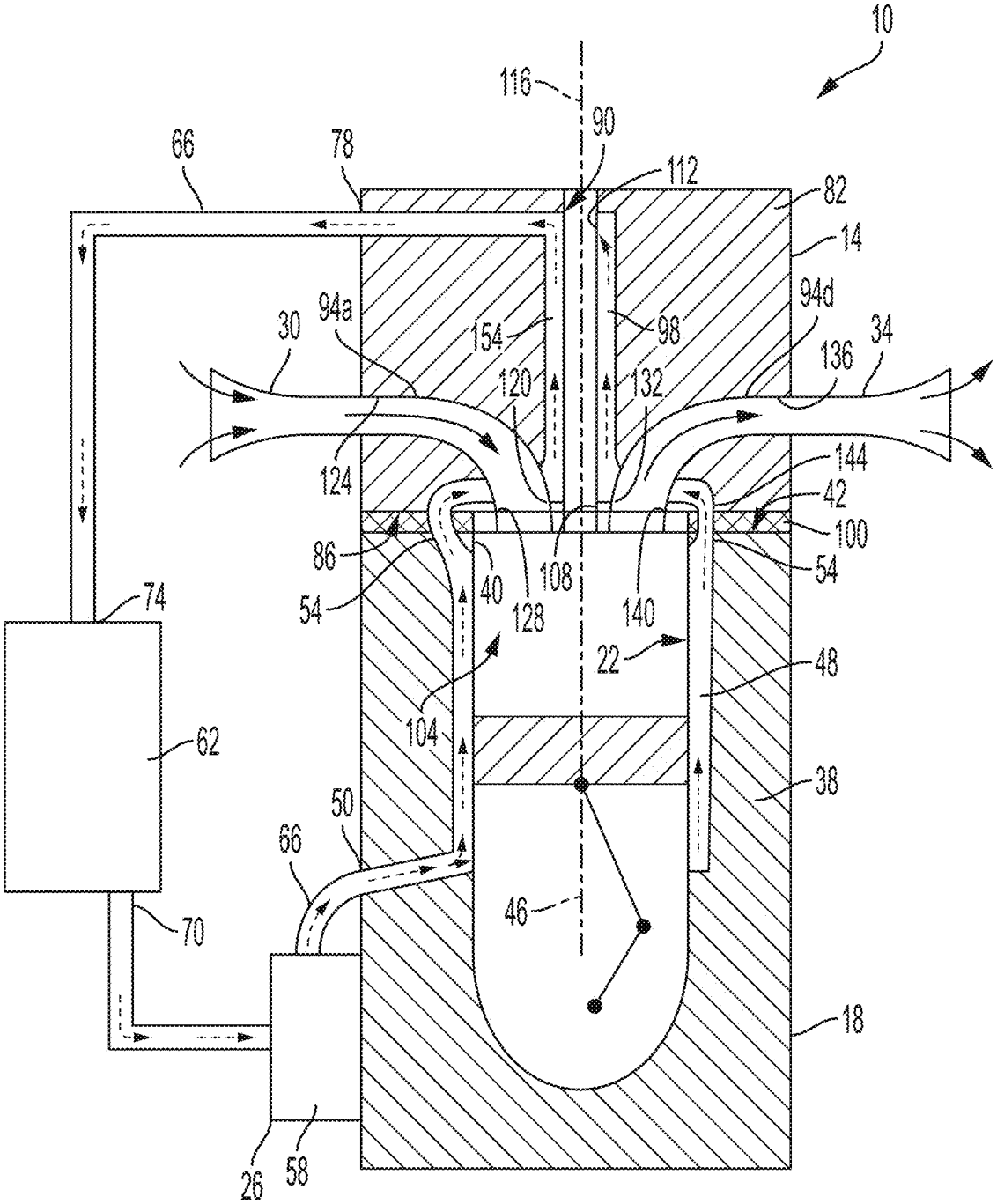
FIG. 1 is a system view of the internal combustion engine including a cylinder head with improved valve bridge cooling capabilities.
Figure 2:
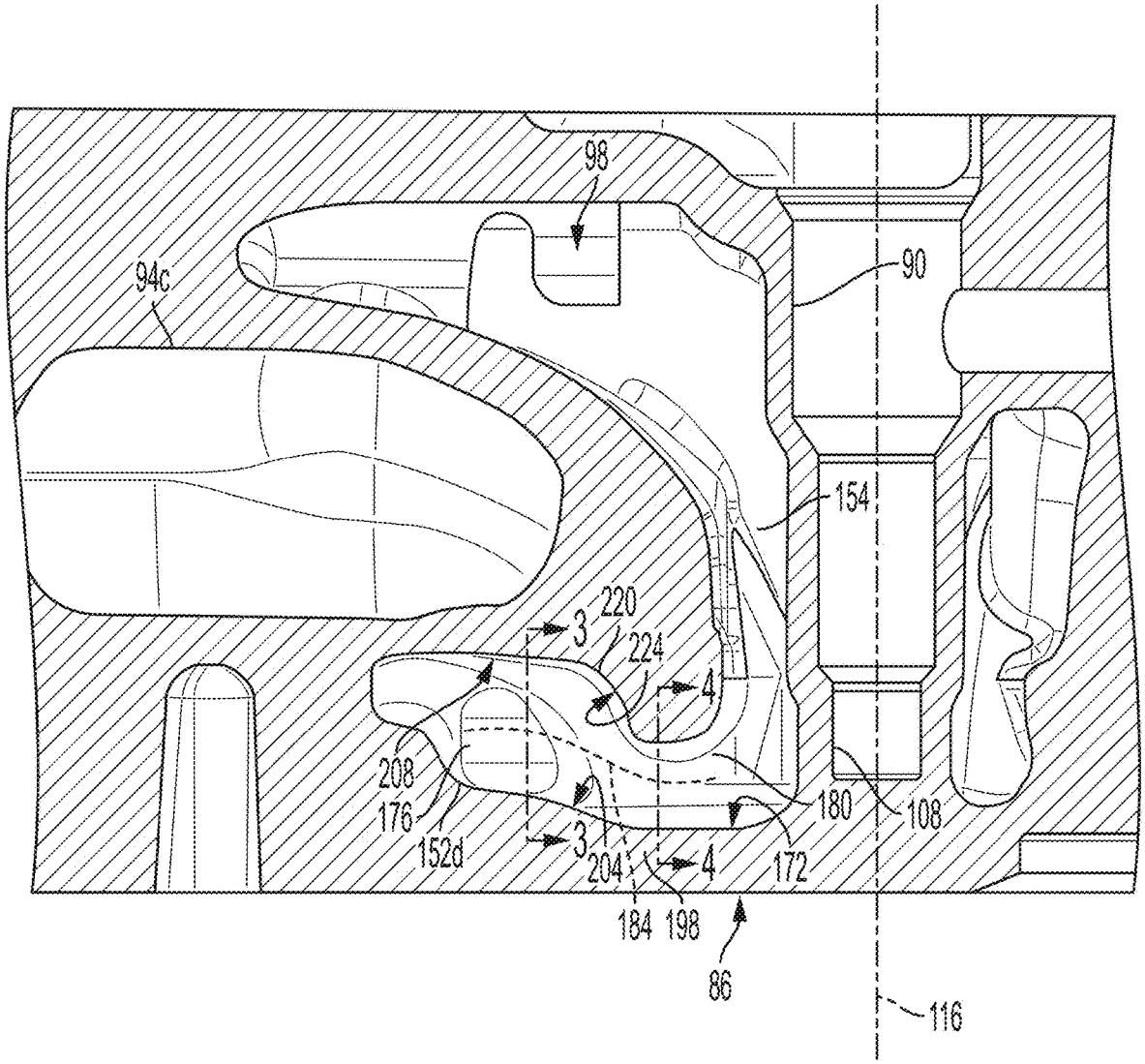
FIG. 2 is a section view of the cylinder head of FIG. 1 taken lengthwise along the E-E valve bridge.
Figure 3:
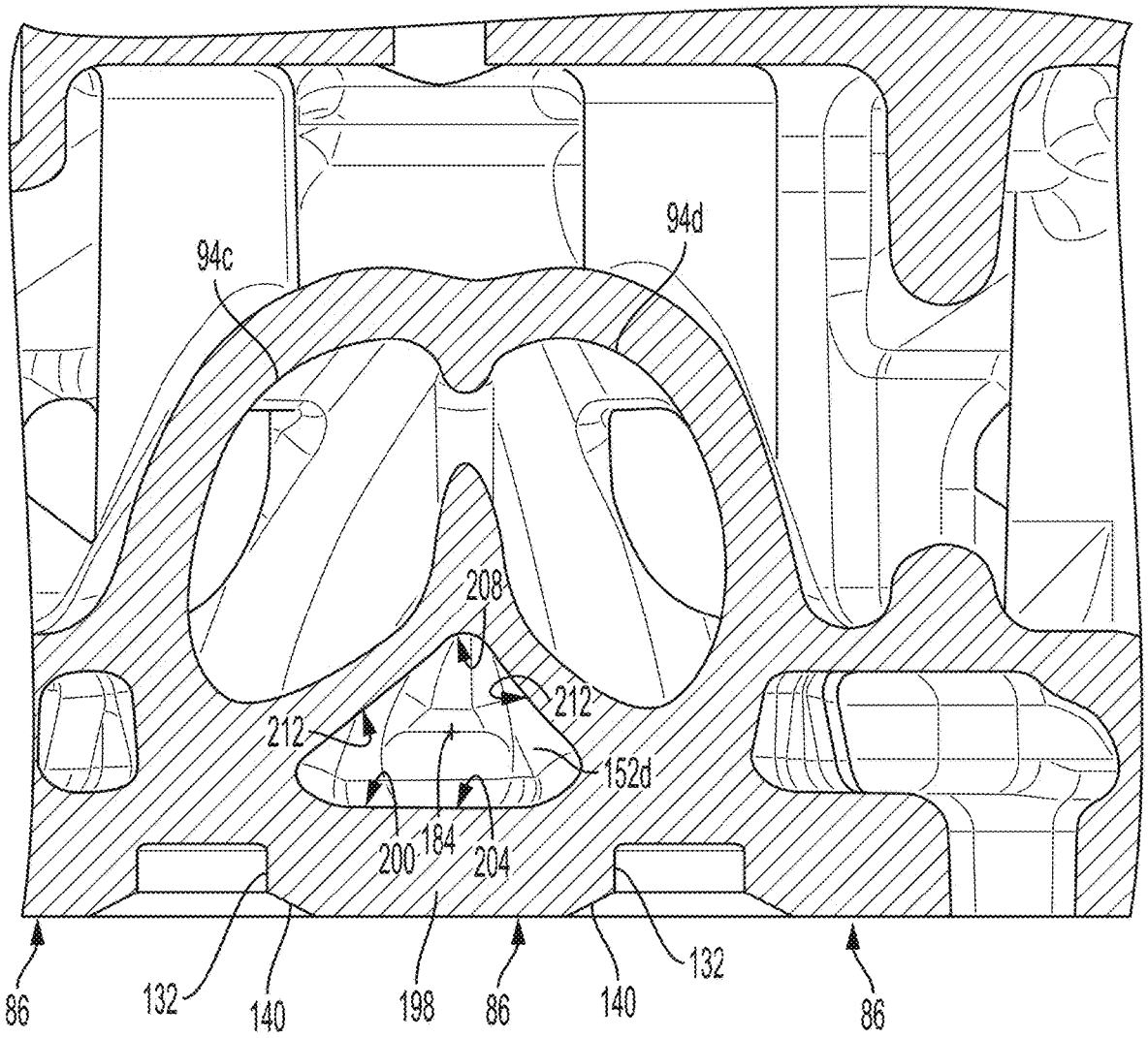
FIG. 3 is a section view taken along line 3-3 of FIG. 2.
Figure 4:
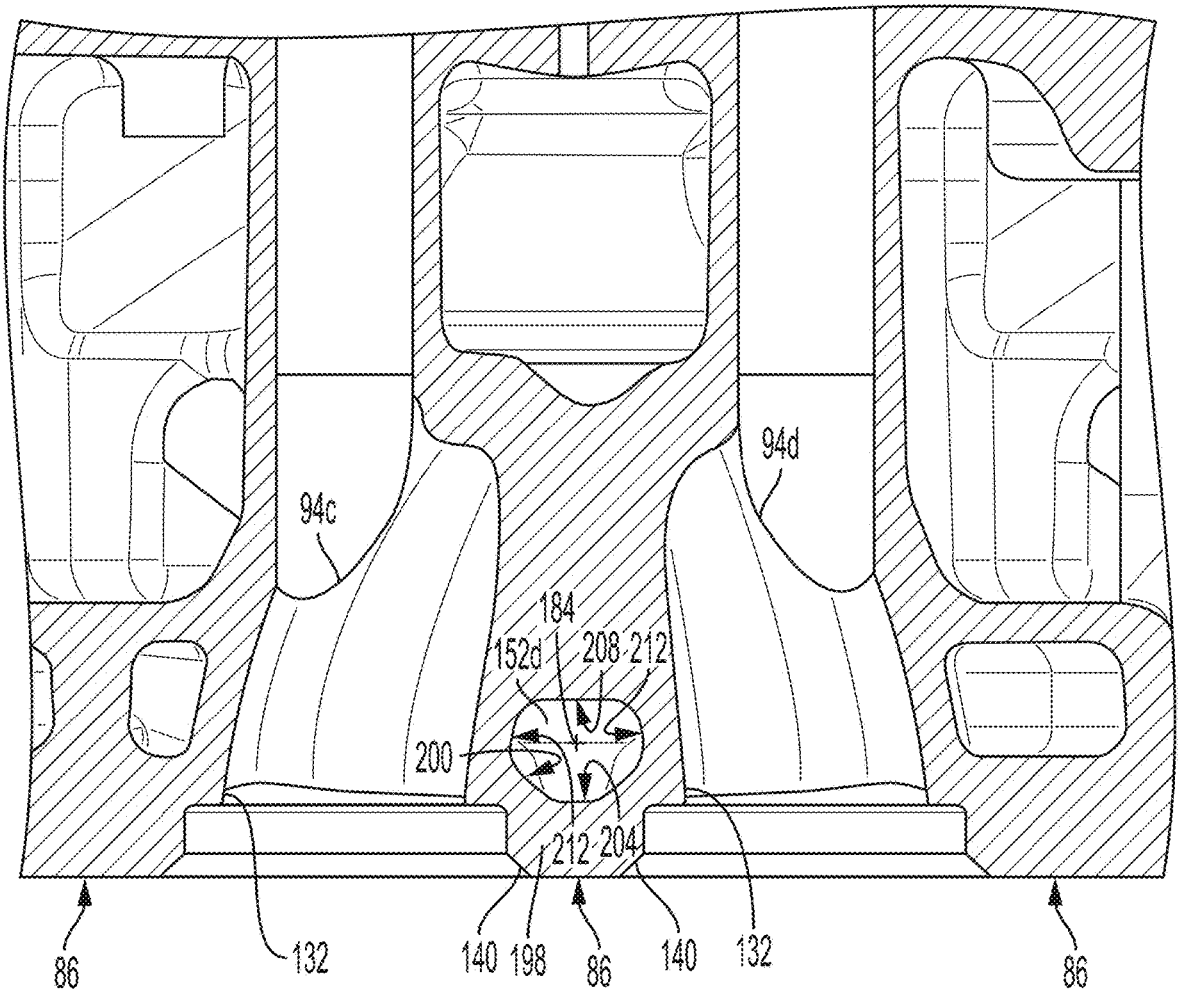
FIG. 4 is a section view taken along line 4-4 of FIG. 2.

FIG. 1 illustrates an internal combustion engine 10 having cylinder heads 14 with improved valve bridge cooling capabilities. More specifically, the internal combustion engine 10 includes a block 18, a cylinder head 14 coupled to the block 18, a cooling system 26 to circulate coolant through the block 18 and cylinder head 14, an intake manifold 30, and an exhaust manifold 34.

The block 18 of the internal combustion engine 10 includes a body 38 including a deck surface 42. The block 18 also includes at least one cylinder 22 defined by the body 38 and having an open end 40 open to the deck surface 42. In the illustrated implementation, the cylinder 22 also defines a cylinder axis 46 extending therethrough. While the illustrated block 18 is shown as having a single deck surface 42 to which all cylinders 22 are open (e.g., an inline layout), it is to be understood that in alternative implementations different shape and types of engine may be used.

The block 18 of the internal combustion engine 10 also defines a block water jacket 48 therein. The block water jacket 48 includes a series of channels and cavities (see FIG. 1) through which coolant is pumped during operation to keep the various areas and components of the block 18 cool and prevent overheating. More specifically, the block water jacket 48 defines a block inlet 50, through which the coolant is introduced into the block water jacket 48, and a block outlet 54, through which the coolant exits the block water jacket 48. In the illustrated implementation, the block outlets 54 of the block water jacket 48 are formed into and open to the deck surface 42 of the block 18 (see FIG. 1).

The cooling system 26 of the internal combustion engine 10 includes a pump 58, a radiator 62 in fluid communication with the pump 58, and a series of pipes 66 to convey the coolant between the various elements of the internal combustion engine 10. During use, the pump 58 draws cooled liquid from the outlet 70 of the radiator 62 and directs the cooled liquid into the internal combustion engine 10 where it subsequently flows through the water jackets of the block 18 and cylinder head 14 to absorb heat therefrom. After flowing through the water jackets the heated liquid returns to the radiator 62 (e.g., via the inlet 74 thereof) where the liquid is cooled and re-circulated through the circuit as is well known in the art. In the illustrated implementation, the pump 58 of the cooling system 26 is configured to pump the cooled liquid into the block inlet 50 (described above) and the inlet 74 of the radiator 62 is configured to receive heated liquid from the cylinder head outlet 78 (described below).

The cylinder head 14 of the internal combustion engine 10 includes a body 82 with a fire deck 86, an injector channel 90 open to the fire deck 86, a plurality of runners 94*a*, 94*b*, 94*c*, 94*d* open to the fire deck 86, and a cylinder head water jacket 98 in fluid communication with the cooling system 26. When assembled, the fire deck 86 of the cylinder head 14 is configured to be coupled to the deck surface 42 of the block 18 with a head gasket 100 positioned therebetween. More specifically, the cylinder head 14 is coupled to the block 18 such that the fire deck 86 at least partially encloses the open ends 40 of the cylinder 22 to form a combustion chamber 104 therebetween. More specifically, the fire deck 86 of the illustrated implementation forms at least one wall of the combustion chamber 104.

While the illustrated fire deck 86 is substantially planar, it is to be understood that in some implementations, the fire deck 86 may also include one or more combustion chamber recesses (not shown) formed therein. In such implementations, the injector channel 90, and the plurality of runners 94*a*, 94*b*, 94*c*, 94*d* may be open to the combustion chamber recess.

The injector channel 90 of the cylinder head 14 includes an elongated channel sized and shaped to receive at least a portion of a fuel injector (not shown) therein. The injector channel 90 includes a first end 108 open to the fire deck 86, a second end 112 opposite the first end 108 that is open to the exterior of the cylinder head 14, and an injector axis 116 extending therethrough. In the illustrated implementation, the injector channel 90 is oriented substantially normal to the fire deck 86 and co-axial with the cylinder axis 46.

Each runner 94*a*, 94*b*, 94*c*, 94*d* of the plurality of runners includes an elongated channel defined by the body 82 that is configured to selectively convey gasses into or out of the combustion chamber 104. In the illustrated implementation, the cylinder head 14 includes two intake runners 94*a*, 94*b*, and two exhaust runners 94*c*, 94*d*.

As shown in FIG. 1, the intake runners 94*a*, 94*b* of the cylinder head 14 extend between and are in fluid communication with the intake manifold 30 and the combustion chamber 104. More specifically, each intake runner 94*a*, 94*b*, includes a first end 120 that is open to the fire deck 86 (e.g., the combustion chamber 104), and a second end 124 opposite the first end 120 that is open to the exterior of the cylinder head 14 and substantially aligned with a corresponding opening of the intake manifold 30. The first end 120 of the intake runners 94*a*, 94*b* also at least partially define a valve seat 128 for selective engagement with a corresponding valve (not shown) as is well known in the art. During use, each intake runner 94*a*, 94*b* receives a flow of intake gasses from the intake manifold, and conveys the intake gasses into the combustion chamber 104 when the valve is in the open position (e.g., disengaged from the valve seat 128).

As shown in FIGS. 1-4, the exhaust runners 94*c*, 94*d* of the cylinder head 14 extend between and are in fluid communication with the exhaust manifold 34 and the combustion chamber 104. More specifically, each exhaust runner 94*c*, 94*d* includes a first end 132 that is open to the fire deck 86 (e.g., the combustion chamber 104), and a second end 136 opposite the first end 132 that is open to the exterior of the cylinder head 14 and in fluid communication with the exhaust manifold 34. The first end 132 of each exhaust runner 94*a*, 94*b* also at least partially defines a valve seat 140 for selective engagement with a corresponding valve (not shown) as is well known in the art. During use, each exhaust runner 94*c*, 94*d* receives an intermittent flow of exhaust gasses from the combustion chamber 104 when the corresponding valve is in the open position (e.g., disengaged form the valve seat 140) and conveys the exhaust gasses to the exhaust manifold 34 for subsequent dispersal.

In the illustrated implementation, the first ends 120, 132 of each runner 94*a*, 94*b*, 94*c*, 94*d*, are positioned evenly about a reference circle (not shown) positioned concentrically with the injector axis 116. In particular the runners 94*a*, 94*b*, 94*c*, 94*d* are positioned such that the two intake runners 94*a*, 94*b* are positioned adjacent one another and the two exhaust runners 94*c*, 94*d* are also positioned adjacent one another (see FIG. 6).

Illustrated in FIGS. 1-7, the cylinder head water jacket 98 of the cylinder head 14 generally includes a series of channels and cavities formed into the body 82 thereof through which coolant is pumped during operation to cool the cylinder head 14 and prevent overheating. More specifically, the cylinder head water jacket 98 includes a head inlet 144, through which the coolant is introduced into the cylinder head water jacket 98, a head outlet 78 where coolant exits the cylinder head water jacket 98, and a plurality of valve bridge channels 152*a*, 152*b*, 152*c*, 152*d*, each extending between a pair of adjacent runners 94*a*, 94*b*, 94*c*, 94*d*.

In the illustrated implementation, the head inlet 144 is formed into the fire deck 86 and substantially aligned with the corresponding block outlet 54 such that the coolant exiting the block water jacket 48 is directed into the cylinder head water jacket 98. Furthermore, the head outlet 78 is in fluid communication with the inlet 74 of the radiator 62 to direct heated coolant into the radiator 62 to complete the cooling circuit. While the illustrated cooling circuit includes pumping coolant through the block 18 before the cylinder head 14, in alternative implementations, coolant may be pumped into the cylinder head 14 before being directed into the block 18 (not shown). In still other implementations, coolant may be pumped through the cylinder head 14 and block 18 as two separate and parallel circuits (not shown).

As shown in FIGS. 2-7, each valve bridge channel 152*a*, 152*b*, 152*c*, 152*d* of the cylinder head water jacket 98 is in fluid communication with the cooling system 26 and configured to direct coolant between two adjacent runners 94*a*, 94*b*, 94*c*, 94*d* proximate the fire deck 86 by sharing a common wall 198 therewith. This area of the cylinder head 14 is particularly in need of cooling as the material is relatively thin and the area is exposed to the extreme heat produced within the combustion chamber 104 (e.g., applied to the fire deck 86) and, in the instances of the exhaust runners 94*c*, 94*d*, the extreme heat of the exhaust gasses flowing through the body 82. In the illustrated implementation, the cylinder head water jacket 98 includes an I-I valve bridge channel 152*a* generally positioned between the two inlet runners 94*a*, 94*b*, a pair of I-E valve bridge channels 152*b*, 152*c* generally positioned between an inlet runner 94*a*, 94*b* and an exhaust runner 94*c*, 94*d*, and an E-E valve bridge channel 152*d*, generally positioned between the two exhaust runners 94*c*, 94*d*.

Figure 6:
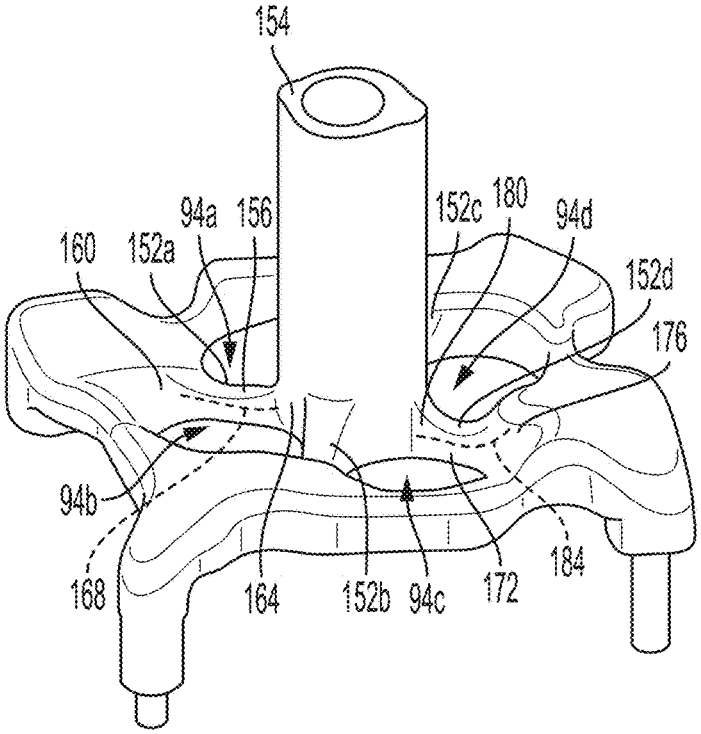
FIG. 6 is perspective view of the cylinder head water jacket of the cylinder head of FIG. 1.
Figure 7:
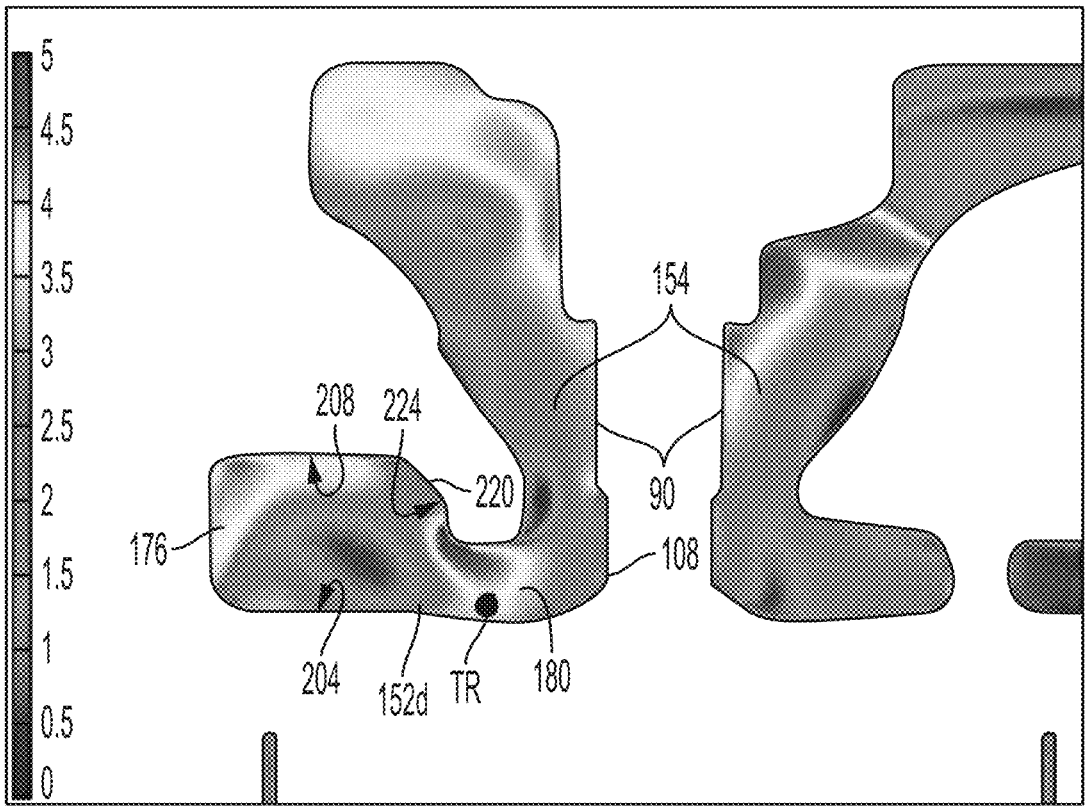
FIG. 7 is a flow diagram of the cylinder head water jacket of FIG. 6.

As shown in FIG. 6, the I-I valve bridge channel 152*a* and two I-E valve bridge channels 152*b*, 152*c* are substantially similar in shape each having an elongated channel 156 with a bridge inlet 160, a bridge outlet 164 downstream of the bridge inlet 160, and defining a flow axis 168 therethrough. For the purposes of this application, a flow axis 168 is generally defined as an axis extending along the length of the valve bridge channels 152*a*, 152*b*, 152*c* while being positioned at the cross-sectional geometric center thereof.

In the illustrated implementation, each flow axis 168 of the I-I and I-E valve bridge channels 152*a*, 152*b*, 152*c* is oriented substantially parallel to the fire deck 86 and radially aligned to the injector axis 116. Furthermore, in the illustrated implementation the I-I and I-E valve bridge channels 152*a*, 152*b*, 152*c* all include a generally constant cross-sectional shape and size along the majority of its length with slight flares (e.g., increases in cross-sectional size and shape) proximate each end (see FIG. 6). Still further, the illustrated I-I and I-E valve bridge channels 152*a*, 152*b*, 152*c* are oriented such that the bridge inlets 160 are positioned radially outwardly from the bridge outlets 164 so that, during use, the coolant enters the valve bridge channels 152*a*, 152*b*, 152*c*, away from the injector channel 90 and flows radially inwardly along the valve bridge channels 152*a*, 152*b*, 152*c*, toward the injector channel 90 and through the corresponding bridge outlet 164 where the coolant exits the area through an injector channel 154 which leads to the cylinder head outlet 78.

As shown in FIGS. 2-7, the E-E valve bridge channel 152*d* includes an elongated channel 172 having a bridge inlet 176, a bridge outlet 180 downstream of the bridge inlet 176, and defining a flow axis 184 (defined above) therethrough. More specifically, the channel 172 of the E-E valve bridge channel 152*d* includes a first region 188 proximate the bridge inlet 176, a second region 192 downstream of the first region 188, and a third region 196 downstream of the second region 192 and proximate to the bridge outlet 180. During use, the E-E valve bridge channel 152*d* is configured to receive a flow of fluid therein and produce a turbulent region TR (e.g., a region of flow having a Reynolds Number>approximately 2300) within the channel 152*d* and proximate the common wall 198. More specifically, the E-E valve bridge channel 152*d* generates a turbulent region TR by directing at least a portion of the flow toward the common wall 198. In other implementations, the turbulent region may include a Reynolds number>approximately 2900.

In the illustrated implementation, the E-E valve bridge channel 152*d* is oriented such that the bridge inlet 176 is positioned radially outwardly from the bridge outlet 180 so that, during use, the coolant enters the bridge inlet 176 away from the injector channel 90 and flows along the valve bridge channel 152*d* radially inwardly toward the injector channel 90 and through the corresponding bridge outlet 180 where the coolant exits the area through the injector channel 154 which leads to the cylinder head outlet 78. However, in alternative implementations the general direction of flow may be reversed.

The channel 172 of the E-E valve bridge channel 152*d* is at least partially defined by the body 82 of the cylinder head 14 and includes an interior surface 200. The interior surface 200, in turn, includes a first or bottom portion 204, a second or top portion 208 opposite the bottom portion 204, and a pair of third or side portions 212 extending between the top portion 208 and the bottom portion 204 (see FIG. 4). In the illustrated implementation, the bottom portion 204 of the interior surface 200 of the channel 172 is positioned proximate to the fire deck 86 such that the fire deck 86 and bottom portion 204 of the interior surface 200 share a common wall 198 (see FIGS. 2-5).

The first region 188 of the E-E valve bridge channel 152*d* extends downstream from the bridge inlet 176 and is shaped such that the top portion 208 and the bottom portion 204 of the interior surface 200 are substantially parallel to one another (see FIG. 5) being spaced a first distance 216 apart. Furthermore, the top portion 208 of the interior surface 200 of the first region 208 is substantially parallel to the flow axis 184.

The second region 192 of the E-E valve bridge channel 152*d* extends downstream from the first region 188 and includes a flow diverter 220 configured to re-direct at least a portion of the coolant flowing through the E-E valve bridge channel 152*d* toward the bottom portion 204 of the interior surface 200 to generate a turbulent region TR. More specifically, the flow diverter 220 is configured to re-direct the portion of coolant flowing proximate the top portion 208 of the channel 172 toward the bottom portion 204 of the channel 172. By doing so, the flow diverter 220 creates a turbulent region TR proximate the bottom portion 204 of the interior surface 200 (e.g., proximate the common wall 198) allowing for a greater amount of heat transfer between the common wall 198 and the coolant flowing within the turbulent region TR (see FIG. 7). Stated differently, the flow diverter 220 is configured to generate a turbulent region TR proximate the bottom portion 204 of the interior surface 200.

Figure 5:
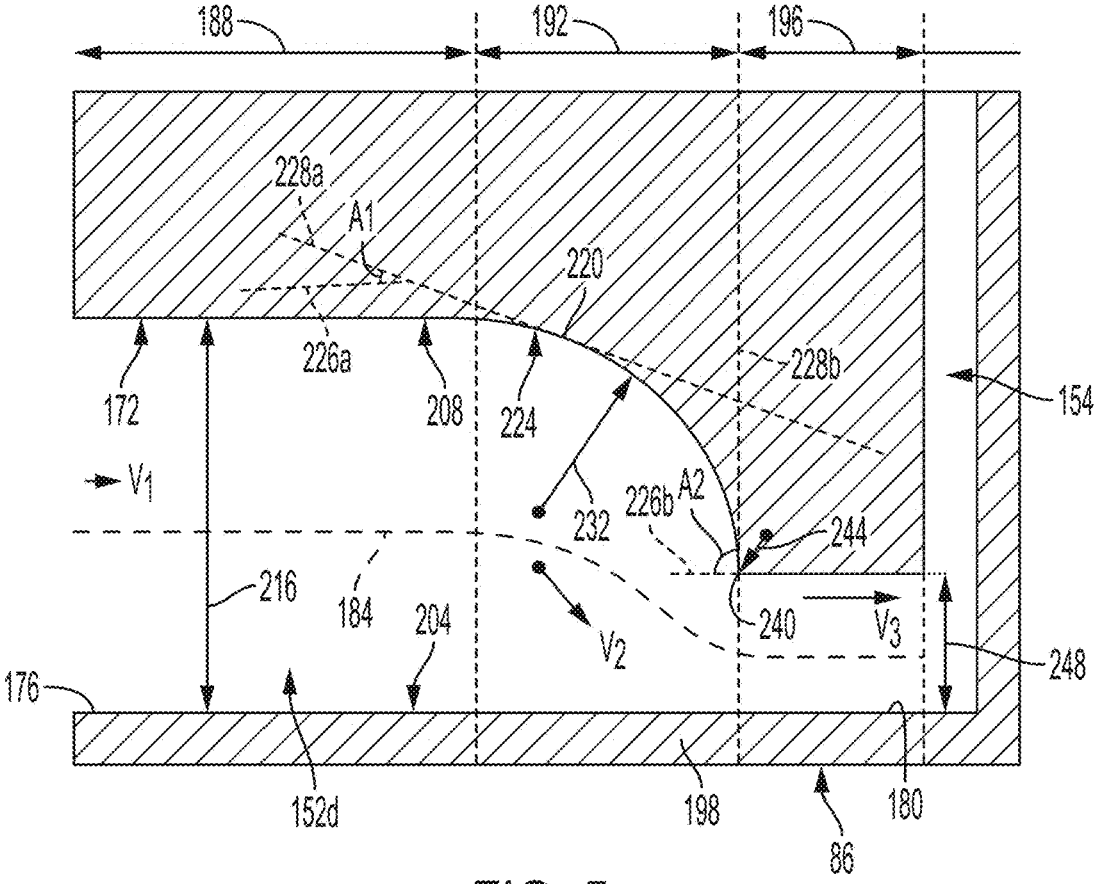
FIG. 5 is a detailed section view of FIG. 2.

As shown in FIG. 5, the flow diverter 220 includes a concave curved diverter surface 224 formed into the upper portion 208 of the interior surface 200 and whose surface angle A1, A2 increases relative to the opposing bottom portion 204 as the flow diverter 220 extends downstream (see FIG. 5). More specifically, the diverter surface 224 includes a continuous concave arcuate shape that extends over at least 45 degrees (e.g., see surface angle A1 versus surface angle A2; FIG. 5). In alternative implementations, the diverter surface 224 may extend over at least 60 degrees. In still other implementations, the diverter surface 224 may extend over at least 90 degrees. For the purposes of this application, the surface angle A1, A2 of the diverter surface 224 is generally defined as the angle between a first reference line 226*a*, 226*b* parallel with the bottom portion 204 of the interior surface 200 and a second reference line 228*a*, 228*b* tangent to the diverter surface 224 at the desired location (see FIG. 5).

The flow diverter 220 also defines a first diverter radius 232 generally indicating the average radius of curvature produced by the diverter surface 224. As shown in FIG. 5, the first diverter radius 232 generally decreases (e.g., becomes more tightly curved) as the diverter surface 224 extends downstream. However, in alternative implementations, the first diverter radius 232 may be even along the entire length of the diverter surface 224.

The flow diverter 220 also defines a maximum surface angle A2 generally defined as the maximum surface angle formed by the diverter surface 224 and the corresponding bottom portion 204 of the interior surface 200 (as defined above). Stated differently, the top portion 208 of the interior surface 200 of the channel 172 forms a surface angle (e.g., the maximum surface angle) relative to the bottom portion 204 of approximately 90 degrees in at least one location. However, in alternative implementations, the flow diverter 220 may include a maximum surface angle between approximately 45 degrees and approximately 90 degrees. In still other implementations, the flow diverter 220 may include a maximum surface angle of between about 70 degrees and about 90 degrees. In still other implementations, the flow diverter 220 may include a maximum surface angle of approximately 80 degrees. In still other implementations, the flow diverter 220 may include a maximum surface angle between approximately 45 degrees and approximately 95 degrees. In still other implementations, the flow diverter 220 may include a maximum surface angle greater than approximately 45 degrees, 55 degrees, 65 degrees, 75 degrees, 85 degrees, or 90 degrees.

The flow diverter 220 also defines a downstream transition 240 positioned immediately downstream of the diverter surface 224 and configured to transition the diverter surface 224 to the upper portion 208 of the interior surface 200 of the third region 196 of the channel 172. More specifically, the downstream transition 240 includes the region where the concave shape of the diverter surface 224 transitions to a convex radius. In the illustrated implementation, the downstream transition 240 includes a transition radius 244 that is less than the first diverter radius 232. In some implementations, the convex radius 244 of the downstream transition 240 is less than 10% of the first diverter radius 232. In still other implementations, the convex radius 244 of the downstream transition 240 is less than 5% of the first diverter radius 232. In still other implementations, the downstream transition 240 is less than 25% of the diverter radius 232. In still other implementations, the downstream transition 240 is less than 50% of the diverter radius 232.

The third region 196 of the E-E valve bridge channel 152*d* extends downstream from the second region 192 to produce the bridge outlet 180. The third region 196 is shaped such that the top portion 208 and the bottom portion 204 of the interior surface 200 of the channel 172 are substantially parallel to one another (see FIG. 5) and spaced a second distance 248 from one another that is less than the first distance 216 (described above). Furthermore, the top portion 208 of the interior surface 200 is substantially parallel to the flow axis 184 in the third region 196.

While only the E-E valve bridge channel 152*d* is shown as including a flow diverter 220, it is to be understood that the disclosed geometry may be included in any one of the other valve bridge channels 152*a*, 152*b*, 152*c*.

During use, coolant enters the E-E bridge via the bridge inlet 176 (e.g., radially away from the injector axis 116) and flows along the channel 172 radially inwardly toward the bridge outlet 180. As it flows through the channel 172, the coolant flows through the first region 188 at a first speed and a first direction (generally indicated by V1; see FIG. 5). While flowing through the first region 188 the flow is substantially parallel to the flow axis 184.

After flowing through the first region 188, the coolant flows into the second region 192 where at least a portion of the flow comes into contact with the diverter surface 224 of the flow diverter 220. Upon interacting with the flow diverter 220 at least a portion of the coolant (e.g., the portion of the coolant flow positioned proximate the top portion 208 of the inner surface 200) travels along the diverter surface 224 and is re-directed toward the opposing bottom portion 204 of the interior surface 200 causing the average flow direction of the coolant to become angled relative to the flow axis 184 toward the bottom portion 204. Simultaneously, the narrowed cross-sectional area produced by the flow diverter 220 accelerates the coolant flow and creates a turbulent region TR proximate the bottom portion 204 of the interior surface 200. The turbulent region TR, in turn, allows a larger quantity of heat to be transmitted between the shared wall 198 and the coolant than would be possible with a non-turbulent flow. The resulting flow within the second region 192 is generally in a second direction different that the first direction and a second speed greater than the first speed. More specifically, the second direction is angled more toward the bottom portion 204 than the first direction (generally indicated by V2; see FIG. 5).

Downstream of the turbulent region TR the accelerated coolant then flows through the third region 196 and out of the E-E valve bridge channel 152*d* where it exits the cylinder head water jacket 98 via the head outlet 78. Finally, the coolant is directed back into the inlet 74 of the radiator 62 where it can be recirculated through the cooling system 26.

Figure 8:
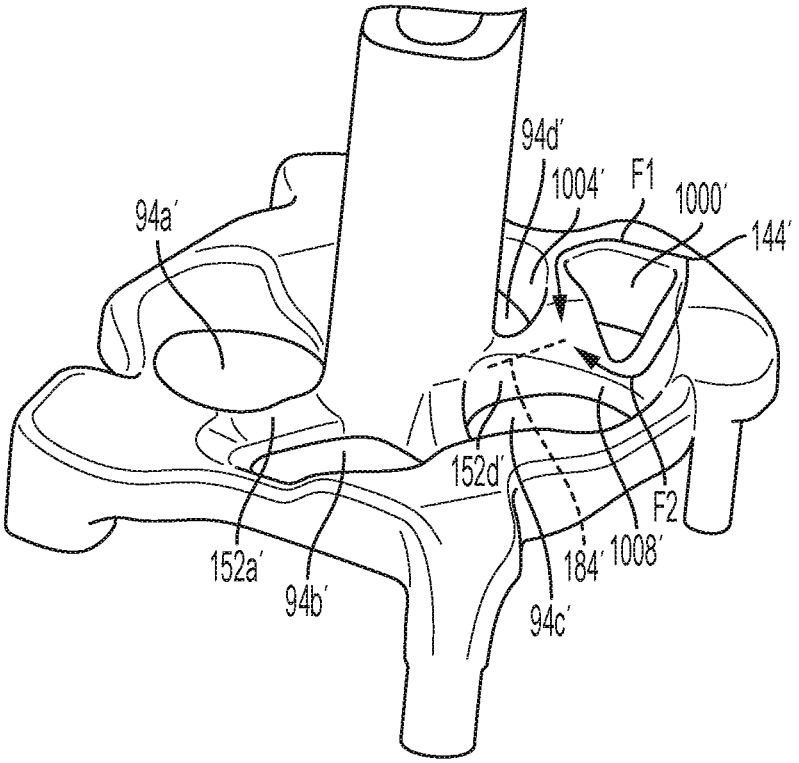
FIG. 8 is a perspective view of an alternative implementation of the cylinder head water jacket of the cylinder head of FIG. 1.
Figure 9:
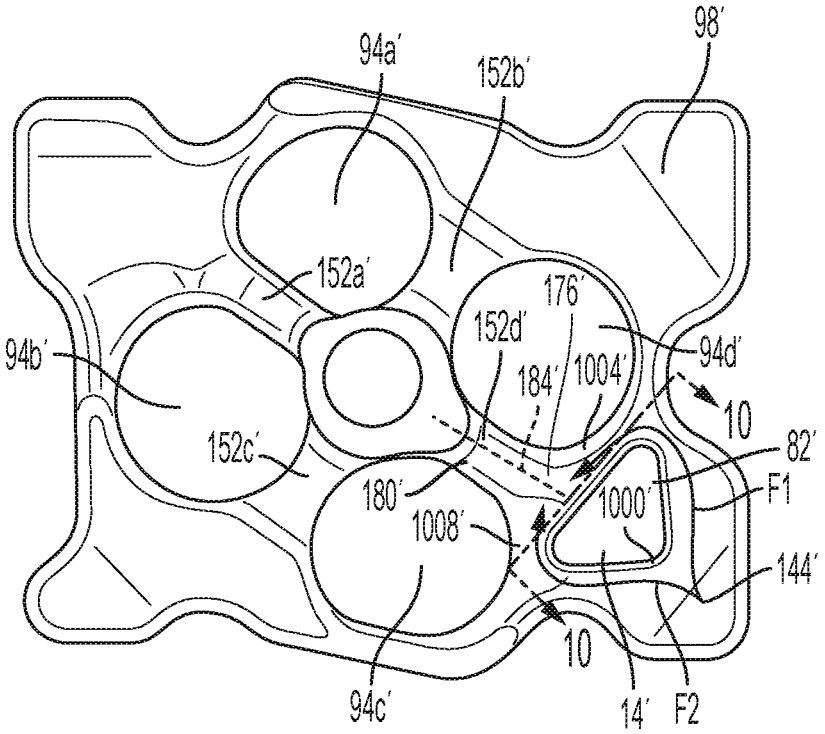
FIG. 9 is a top view of the cylinder head water jacket of FIG. 8.
Figure 10:
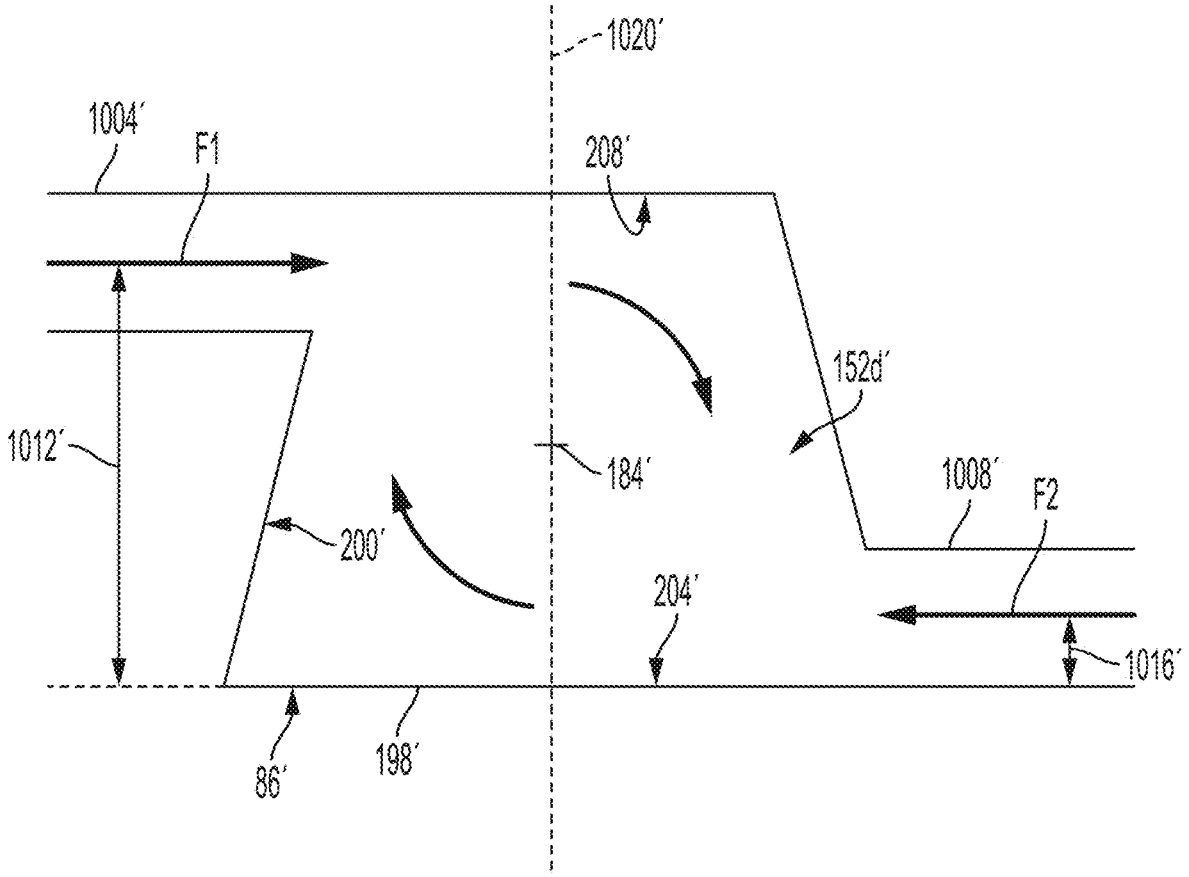
FIG. 10 is a section view taken along line 10-10 of FIG. 9.

FIGS. 8-10 illustrate another implementation of the cylinder head water jacket 98'. The cylinder head water jacket 98' is substantially similar to the cylinder head water jacket 98 described above. As such, only the differences between the two will be discussed herein.

The cylinder head water jacket 98' includes a plurality of valve bridge channels 152*a*', 152*b*', 152*c*', 152*d*' each positioned between adjacent runners 94*a*', 94*b*', 94*c*', 94*d*'. Specifically, the cylinder head water jacket 98' includes an E-E valve bridge channel 152*d*' having a bridge inlet 176' and a bridge outlet 180' downstream of the bridge inlet 176'. The bridge inlet 176', in turn, includes a flow divider 1000', a first sub-inlet 1004', and a second sub-inlet 1008'. The E-E bridge channel 152*d*' also defines a first plane 1020' passing through cross-sectional center of the channel 152*d*' and oriented substantially perpendicular to the fire deck 86'.

As shown in FIG. 9, the flow divider 1000' includes a wall or other element positioned within the water jacket 98' and upstream of the bridge inlet 176' to divide the flow of coolant provided by the head inlet 144' into two separate flows F1, F2. While the illustrated flow divider 1000' includes a triangularly shaped wall, in alternative implementations other geometric shapes may be used. Furthermore, while the flow divider 1000' of the illustrated implementation is integrally formed with the body 82' of the cylinder head 14', in alternative implementations the flow divider 1000' could be a separate piece positioned within the jacket 98'.

The first sub-inlet 1004' is configured to receive the first flow F1 of coolant from the flow divider 1000' and direct the first flow F1 into the valve bridge channel 152*d'* at a first location and in a first direction. More specifically, the first sub-inlet 1004' is configured to direct the first flow F1 into the valve bridge channel 152*d'* proximate the second portion 208' of the interior wall 200' (e.g., opposite the fire deck 86') and generally oriented perpendicular to the flow axis 184' of the valve bridge channel 152*d'* and parallel to the fire deck 86'. As shown in FIG. 9, the first location of the first sub-inlet 1004' is generally spaced a first distance 1012' from the fire deck 86'.

The second sub-inlet 1008' is configured to receive the second flow F2 of coolant from the flow divider 1000' and direct the flow F2 into the valve bridge channel 152*d'* at a second location different than the first location and in a second direction different than the first direction. More specifically, the second sub-inlet 1008' is configured to direct the second flow F2 into the valve bridge channel 152*d'* proximate the first portion 204' of the interior wall 200' (e.g., proximate the fire deck 86') and generally oriented perpendicular to the flow axis 184' and parallel to the fire deck 86'. The second direction is also generally opposite the first direction (see FIG. 10) such that the two flows are directed generally toward each other. In some implementations, the orientation of the first direction and the orientation of the second direction are configured such that they are offset from and opposite one another (e.g., the two directions are not aligned).

As shown in FIG. 8, the second location of the second sub-inlet 1008' is generally spaced a second distance 1016' from the fire deck 86' that is less than the first distance 1012' of the first location. Still further, the inlets 1004', 1008' are positioned such that the flow axis 186' is spaced a third distance from the fire deck 86' that is greater than the second distance 1016' but less than the first distance 1012'. Still further, the first sub-inlet 1004' and the second sub-inlet 1008' are oriented on opposite sides of the first plane 1020'.

Together, the first sub-inlet 1004' and the second sub-inlet 1008' are configured to direct the first and second flows F1, F2 such that they interact with one another within the valve bridge channel 152*d'* and create a turbulent region therein. More specifically, the interaction of the first and second flows F1, F2 generate a swirling or vortex motion within the channel 152*d'* (e.g., about the flow axis 184'). The resulting turbulent region is generally positioned proximate the common wall 198' and allows the coolant to absorb an increased level of heat energy from the body 82' of the cylinder head 14' and, more specifically, the common wall 198' of the fire deck 86'.

The invention claimed is:

1. A cylinder head for use with an internal combustion engine, the cylinder head comprising:

a body having a fire deck and defining a water jacket in fluid communication with a cooling system;

an injector channel defining an injector axis;

a first runner defined by the body and open to the fire deck to at least partially form a first valve seat;

a second runner defined by the body and open to the fire deck to at least partially form a second valve seat;

a channel defined by the body, where the cooling channel is in fluid communication with the water jacket and positioned between the first runner and the second runner, wherein the channel defines a direction of flow toward the injector axis, and wherein the channel includes:

a first inlet configured to direct a first flow into the channel in a first direction, and a second inlet configured to direct a second flow into the channel in a second direction different than the first direction;

a head inlet;

a flow divider integrally formed with the body and positioned downstream of the head inlet and upstream of both the first inlet and the second inlet;

wherein the first inlet is configured to direct the first flow into the channel at a first location, and wherein the second inlet is configured to direct the second flow into the channel at a second location different than the first location; and wherein the first location is a first distance from the fire deck, and wherein the second location is a second distance from the fire deck different than the first location.

2. The cylinder head of claim 1, wherein the channel includes an interior surface having a first portion proximate the fire deck, and a second portion opposite the first portion, and wherein the first location is proximate the first portion of the interior surface and the second location is proximate the second portion of the interior surface.

3. The cylinder head of claim 1, wherein the channel defines a first plane passing through the cross-sectional center of the channel and oriented perpendicular to the fire deck, and wherein the first location and the second location are positioned on opposite sides of the first plane.

4. The cylinder head of claim 1, wherein the first direction and the second direction are substantially parallel.

5. A cylinder head for use with an internal combustion engine, the cylinder head comprising:

a body having a fire deck and defining a water jacket in fluid communication with a cooling system;

an injector channel defining an injector axis;

a first runner defined by the body and open to the fire deck to at least partially form a first valve seat;

a second runner defined by the body and open to the fire deck to at least partially form a second valve seat;

a channel defined by the body, where the cooling channel is in fluid communication with the water jacket and positioned between the first runner and the second runner, wherein the channel defines a direction of flow toward the injector axis, and wherein the channel includes:

a first inlet configured to direct a first flow into the channel in a first direction, and a second inlet configured to direct a second flow into the channel in a second direction different than the first direction;

a head inlet;

a flow divider integrally formed with the body and positioned downstream of the head inlet and upstream of both the first inlet and the second inlet;

wherein the first direction and the second direction are substantially parallel; and wherein the first direction and the second direction are offset.

6. The cylinder head of claim 1, wherein at least one of the first direction and the second direction are parallel to the fire deck.

7. A cylinder head for use with an internal combustion engine, the cylinder head comprising:

a body having a fire deck and defining a water jacket in fluid communication with a cooling system;

an injector channel defining an injector axis;

a first runner defined by the body and open to the fire deck to at least partially form a first valve seat;

a second runner defined by the body and open to the fire deck to at least partially form a second valve seat;

a channel defined by the body, where the cooling channel is in fluid communication with the water jacket and positioned between the first runner and the second runner, wherein the channel defines a direction of flow toward the injector axis, and wherein the channel includes:

a first inlet spaced a first distance from the fire deck, and a second inlet spaced a second distance from the fire deck different than the first distance;

a head inlet; and a flow divider integrally formed with the body and positioned downstream of the head inlet and upstream of both the first inlet and the second inlet.

8. The cylinder head of claim 7, wherein the channel defines a flow axis therethrough, and wherein the flow axis is spaced a third distance from the fire deck that is greater than the first distance but smaller than the second distance.

9. The cylinder head of claim 7, wherein the channel defines first plane passing through the cross-sectional center of the channel and oriented perpendicular to the fire deck, and wherein the first inlet and the second inlet are positioned on opposite sides of the first plane.

10. The cylinder head of claim 1, wherein the flow divider is substantially triangular in shape with two surfaces facing upstream and a single surface facing downstream.

11. The cylinder head of claim 5, wherein the channel includes an outlet downstream of the first inlet and the second inlet, and wherein the outlet flows into the injector channel.

12. The cylinder head of claim 1, wherein the channel includes an outlet opposite the first inlet and the second inlet, and wherein the outlet flows into the injector channel.

13. The cylinder head of claim 7, wherein the channel includes an outlet opposite the first inlet and the second inlet, and wherein the outlet flows into the injector channel.

* * * * *